US005967424A

United States Patent [19]

Bonnah, II

[11] Patent Number: 5,967,424

[45] Date of Patent: Oct. 19, 1999

[54] FUEL INJECTOR FILTER

[75] Inventor: Harrie William Bonnah, II, East Grand Rapids, Mich.

[73] Assignee: General Motors Corporation, Detroit, Mich.

[21] Appl. No.: 09/103,437

[22] Filed: Jun. 24, 1998

[51] Int. Cl.[6] ..... B05B 1/14; B05B 1/30

[52] U.S. Cl. ..... 239/575; 239/585.1; 239/DIG. 23

[58] Field of Search ..... 239/575, 585.1, 239/585.3, 585.5, DIG. 23; 210/429, 430

[56] References Cited

U.S. PATENT DOCUMENTS

| | | | |
|---|---|---|---|
| 5,423,489 | 6/1995 | Wood | 239/575 |
| 5,707,012 | 1/1998 | Maier et al. | 239/575 |
| 5,730,368 | 3/1998 | Flik et al. | 239/575 |

*Primary Examiner*—Lesley D. Morris
*Attorney, Agent, or Firm*—Karl F. Barr; Vincent A. Cichosz

[57] ABSTRACT

The present invention relates to a fuel injector for delivery of fuel to an internal combustion engine comprising an injector body and a fuel discharge opening having a valve seat extending thereabout. A valve element is normally seated on the valve seat to close the fuel discharge opening and is operable to move inwardly off of the valve seat to open the fuel discharge opening allowing fuel to pass through. An annular valve guide is seated upstream of the valve seat in spaced relationship thereto and extends about the valve element to guide it as the valve element moves relative to the valve seat. The valve guide has fuel passages to pass fuel. An annular filter shelf located in the injector body, extends circumferentially about the valve seat intermediate of the valve guide and the valve seat. A filter is disposed intermediate of the valve guide and the valve seat and has a base configured to seat upon the annular filter shelf, an upper end configured to contact the valve guide, and a frustoconical wall extending between the base and the upper end. The wall has filtration openings to filter particulates from fuel passing through so as to prevent them from flowing to the valve seat. A base perimetrical fluid seal is established between the annular filter shelf and the base of the filter, and an upper end perimetrical fluid seal is established between the valve guide and the upper end of the filter where the seals operate to prevent fuel flow around the filter.

4 Claims, 2 Drawing Sheets

FUEL INJECTOR FILTER

TECHNICAL FIELD

This invention relates to a filter for fuel injectors used for delivery of fuel to internal combustion engines.

BACKGROUND OF THE INVENTION

In fuel injectors for internal combustion engines, it is important to minimize contaminants introduced to the fuel injector. Contaminants may interfere with the fuel injector valve if they adhere to the valve seat and prevent the valve from completely seating. One source of contaminants may be the fuel which may be filtered with an external filter upstream of the fuel injector inlet. Contaminants may also originate within the fuel injector during the manufacturing process and such contamination is not affected by an external upstream filter.

SUMMARY OF THE INVENTION

The present invention is directed to a fuel injector, for use in an internal combustion engine, having an internal fuel filter. The filter has a frustoconical, nonrigid configuration. When a valve guide is installed above the filter, the valve guide compresses the frustoconical filter and captures it between the injector body and the valve guide. The compression of the filter operates to establish seals between the nozzle body and the base of the frustoconical filter and between the upper end of the filter and the valve guide. The seals act as fluid barriers to prevent fuel from flowing around, and bypassing the filter. Fuel passes through the filter and contaminants are removed prior to the fuel reaching the valve element to valve seat interface. Since the filter is located closely adjacent to where fuel exits past the valve, it provides the maximum filtering benefit as compared to a filter that is located upstream of the valve guide.

DESCRIPTION OF THE PREFERRED EMBODIMENT

Figure 1:
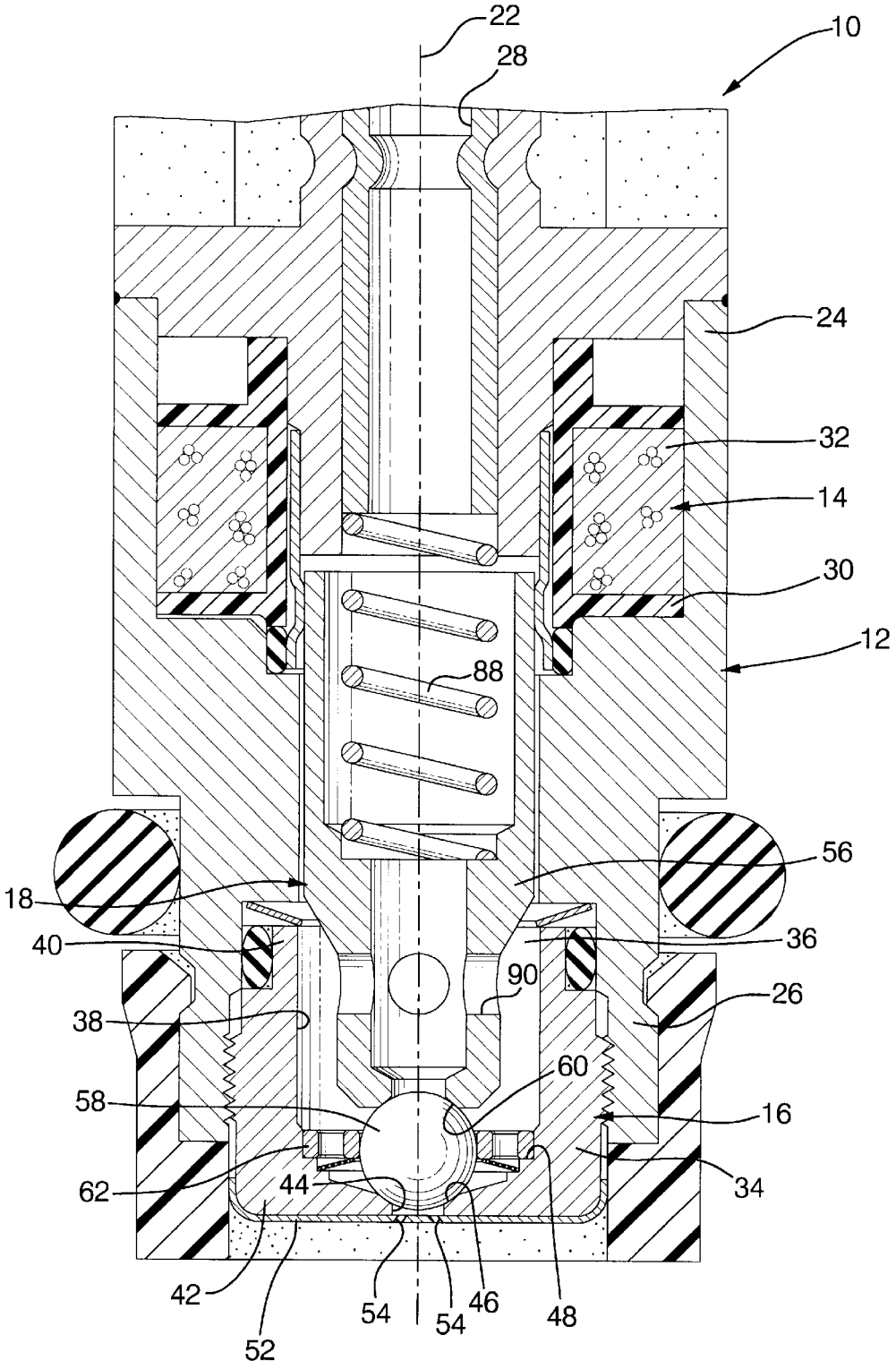
FIG. 1 is a partial side view, in section, of a fuel injector embodying features of the present invention.

FIG. 1 illustrates an electromagnetic fuel injector, designated generally as 10, which includes as major components thereof, an injector body 12, a solenoid actuator assembly 14, a nozzle assembly 16, and a valve assembly 18.

The injector body 12 is a generally cylindrical, hollow tubular member defining a central axis 22. The body 12 includes an upper solenoid case portion 24 and a lower nozzle case portion 26. At the upper end of the injector body 12, a fuel tube 28 delivers pressurized fuel from a fuel source, not shown.

The solenoid actuator assembly 14 is disposed within the upper solenoid case portion 24 and includes a spool-like, tubular bobbin 30 supporting a wound wire solenoid coil 32. Energizing the solenoid coil 32 actuates the valve assembly 18.

The nozzle assembly 16 is disposed within the lower nozzle case portion 26. It includes a nozzle body 34 having a cup-shaped configuration. An internal cylindrical cavity 36 in the nozzle body 34 is defined by a cylindrical wall 38 which extends from an open, upper end 40 of the nozzle body 34 to terminate in a closed, lower end 42 of the nozzle body. The cylindrical cavity 36 operates as a fuel supply repository within the nozzle assembly 16. The closed, lower end 42 of the nozzle body 34 has a fuel discharge opening 44 therethrough, coaxial with the central axis 22 of the injector body 12, and having an annular, frustoconical valve seat 46 disposed thereabout. Positioned radially between the valve seat 46 and the cylindrical wall 38 of the nozzle body 34 are two annular shelves, a valve guide shelf 48 adjacent the cylindrical wall and a filter shelf 50, FIG. 3, adjacent and downstream of the valve guide shelf 48.

At the lower end 42 of the nozzle body 34, downstream of the fuel discharge opening 44, is placed a fuel spray director plate 52. The director plate 52 includes fuel directing openings 54 extending therethrough. Fuel passing through the fuel discharge opening 44 is distributed across the director plate 52 to the fuel directing openings 54. The fuel directing openings 54 are oriented to generate a desired spray configuration in the fuel discharged from the injector 10.

The valve assembly 18 includes a tubular armature 56 extending axially within the injector body 12 and a valve element 58 located within the nozzle body 34. The valve element 58 may be a spherical ball, which is welded to the lower annular end 60 of the tubular armature 56. The radius of the valve element 58 is chosen for seating engagement with the valve seat 46. The tubular armature 56 is formed with a predetermined outside diameter so as to be loosely slidable within the injector body 12.

Figure 3:
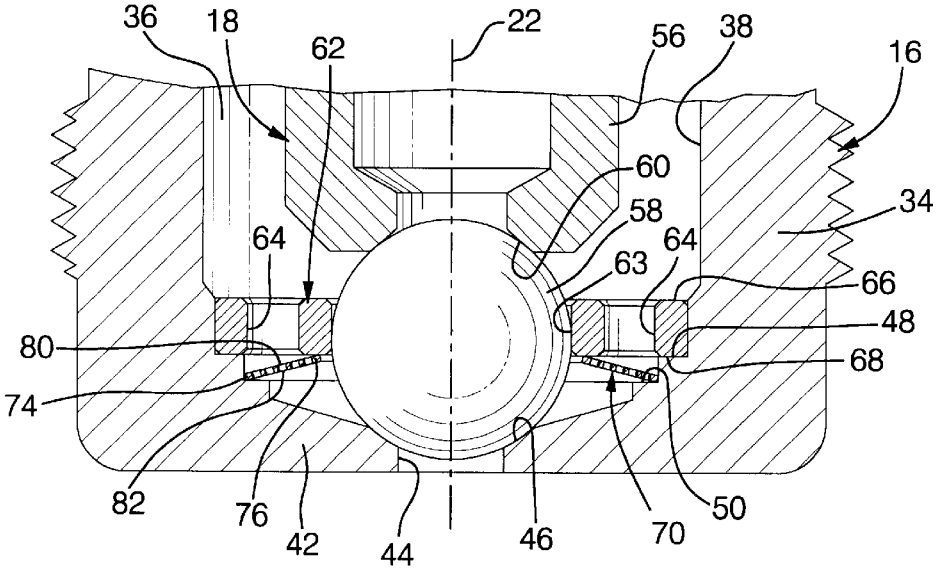
FIG. 3 is an enlarged side view of a portion of FIG. 1 with the present invention installed in the fuel injector.

Coaxially positioned within the cylindrical cavity 36 of the nozzle body 34, seated on the valve guide shelf 48 is a valve guide 62, FIG. 3. The valve guide 62 is configured as an annular disk with a central, valve-guiding opening 63 and a plurality of fuel passages 64 extending from the upstream surface 66 to the downstream surface 68 to allow fuel flow from the cylindrical cavity 36 to the valve seat 46.

Figure 2:
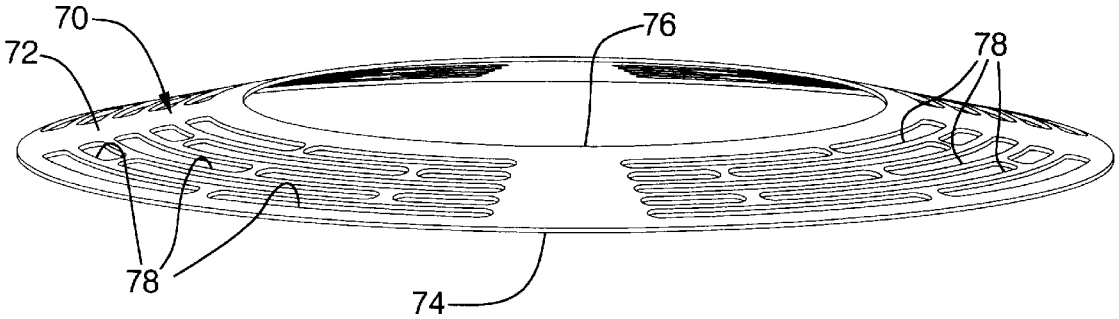
FIG. 2 is an enlarged isometric view of the present invention before it is installed.

A filter 70, FIG. 2, has a frustoconical shape defined by a frustoconical wall 72 extending between a base 74 and an upper end 76. The base 74 is defined by the largest diameter and the upper end 76 is defined by the smallest diameter of the frustoconical wall 72. A plurality of filtration openings 78 extend through the frustoconical wall 72 from the upstream side 80 to the downstream side 82, FIG. 3.

The filter 70 may be constructed of a material such as 300 or 400 series stainless steel. One method of constructing the filtration openings 78 is by overlaying a film with the openings defined, over the frustoconical wall 72 and photochemically etching the filter. The etching process may be performed before or after the filter 70 is stamped to form the frustoconical shape. The filter 70 may also be constructed of a molded plastic with a filtration mesh sonically welded to the base 74 and upper end 76. In a further embodiment, the filter 70 may be completely constructed of a woven mesh. In general, the material selected should compress, but should not relax over time.

FIG. 3 illustrates the installation of the filter 70, with some features exaggerated for clarity. The annular filter shelf 50 located about the valve seat 46 receives the base 74 of the filter 70. The valve guide 62 is then installed above the filter 70 and is seated on the valve guide shelf 48. The valve guide 62 closely encircles the valve element 58 to minimize fuel leakage through the valve guide opening 63 and operates to axially guide the valve element as it moves reciprocally into and out of engagement with the valve seat 46.

The downstream surface 68 of the valve guide 62 contacts the upper end 76 of the frustoconical filter 70 and compresses the frustoconical filter, to positively capture it between the nozzle body 34 and the valve guide 62. The filter 70 responds similarly to a cone spring. The compression of the filter 70 operates to establish a base perimetrical fluid seal 84 between the filter shelf 50 and the base 74 of the filter, FIG. 4. The compression also creates an upper end perimetrical fluid seal 86 between the downstream surface 68 of the valve guide 62 and the upper end 76 of the filter 70. The fluid seals 84,86 act as fluid barriers to prevent fuel from bypassing the filter 70.

Figure 4:
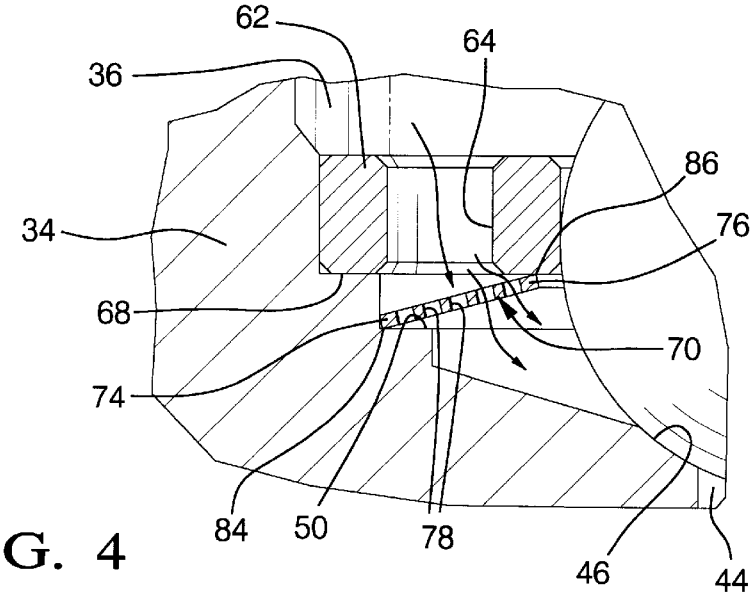
FIG. 4 is an enlarged side view of FIG. 3 illustrating the flow of fuel.

As a result of the installation of the filter 70 and valve guide 62 described, fuel flowing from the cylindrical cavity 36 through the valve guide fuel passages 64 flows through the filtration openings 78 where particulates are removed prior to reaching the valve seat 46, FIG. 4. Since the filter 70 is positively captured into position, it will not move or disrupt the fuel flow pattern therethrough. Additionally, the closely adjacent location, afforded by the downstream positioning of the filter 70, ensures that maximum filtration occurs before fuel exits past the valve seat 46.

The valve element 58 of the valve assembly 18 is normally biased into closed, seated engagement with the valve seat 46 by a biasing member such as a valve return spring 88, FIG. 1. Upon energizing the solenoid assembly 14, the tubular armature 56 and associated valve element 58 are drawn axially upwardly, off of the valve seat 46 against the bias of the return spring 88. Pressurized fuel enters the injector 10 from the fuel source, not shown, passes through the fuel tube 28, to enter the cylindrical cavity 36 in the nozzle body 34 through circumferentially spaced openings 90 in the tubular armature 56. The fuel passes through the valve guide fuel passages 64 and the filtration openings 78 in the filter frustoconical wall 72 and exits through the fuel discharge opening 44 in the valve seat 46. Fuel exiting the fuel discharge opening 44 is distributed across the fuel director plate 52 to the fuel directing openings 54, for discharge from the fuel injector 10. Deenergizing the solenoid assembly 14 releases the tubular armature 56, which returns the valve element 58 to the normally closed position against the valve seat 46 under the bias of the return spring 88, and stops the flow of fuel therethrough.

The foregoing description of the preferred embodiment of the invention has been presented for the purpose of illustration and description. It is not intended to be exhaustive, nor is it intended to limit the invention to the precise form disclosed. It will be apparent to those skilled in the art that the disclosed embodiment may be modified in light of the above teachings. The embodiment was chosen to provide an illustration of the principles of the invention and its practical application to thereby enable one of ordinary skill in the art to utilize the invention in various embodiments and with various modifications as are suited to the particular use contemplated. Therefore, the foregoing description is to be considered exemplary, rather than limiting, and the true scope of the invention is that described in the following claims.

I claim:

1. A fuel injector for delivery of fuel to an internal combustion engine comprising an injector body, a central axis defined by said injector body, a fuel discharge opening coaxial with said central axis having a valve seat extending thereabout, a valve element normally seated on said valve seat to close said fuel discharge opening and operable to move inwardly off of said valve seat to open said fuel discharge opening allowing fuel to pass therethrough, an annular valve guide seated coaxially with said central axis upstream of said valve seat in spaced relationship thereto and extending about said valve element to guide said valve element as said valve element moves relative to said valve seat, said valve guide having fuel passages extending therethrough to conduct fuel through said valve guide, and a filter disposed intermediate of said valve guide and said valve seat having a frustoconical wall, including filtration openings extending through said frustoconical wall, to filter particulates from fuel passing therethrough, wherein particulates are prevented from flowing to said valve seat.

2. A fuel injector for delivery of fuel to an internal combustion engine, as defined in claim 1, further comprising an annular filter shelf located in said injector body, extending circumferentially about said valve seat intermediate of said valve guide and said valve seat, said filter further comprising a base configured to seat upon and fluidly seal against said annular filter shelf and an upper end configured to contact and fluidly seal against said valve guide.

3. A fuel injector for delivery of fuel to an internal combustion engine comprising an injector body, a central axis defined by said injector body, a fuel discharge opening coaxial with said central axis having a valve seat extending thereabout, a valve element normally seated on said valve seat to close said fuel discharge opening and operable to move inwardly off of said valve seat to open said fuel discharge opening allowing fuel to pass therethrough, an annular valve guide seated coaxially with said central axis upstream of said valve seat in spaced relationship thereto and extending about said valve element to guide said valve element as said valve element moves relative to said valve seat, said valve guide having fuel passages extending therethrough to conduct fuel through said valve guide, an annular filter shelf located in said injector body, extending circumferentially about said valve seat intermediate of said valve guide and said valve seat, and a filter disposed intermediate of said valve guide and said valve seat, having a base configured to seat upon said annular filter shelf, an upper end configured to contact said valve guide, and a frustoconical wall extending between said base and said upper end including filtration openings extending through said frustoconical wall to filter particulates from fuel passing therethrough, wherein particulates are prevented from flowing to said valve seat.

4. A fuel injector for delivery of fuel to an internal combustion engine, as defined in claim 3, said filter positively captured between said valve guide and said annular filter shelf to define a base perimetrical fluid seal established between said annular filter shelf and said base of said filter, and an upper end perimetrical fluid seal established between said valve guide and said upper end of said filter, said seals operable to prevent fuel flow around said filter.

* * * * *